United States Patent [19]

Weber

[11] Patent Number: 4,905,630

[45] Date of Patent: Mar. 6, 1990

[54] METHOD AND APPARATUS FOR RENEWING A VERTICALLY DISPOSED STEAM GENERATOR, IN PARTICULAR IN NUCLEAR POWER PLANTS

[75] Inventor: Robert Weber, Uttenreuth, Fed. Rep. of Germany

[73] Assignee: Siemens Aktiengesellschaft, Munich, Fed. Rep. of Germany

[21] Appl. No.: 286,539

[22] Filed: Dec. 19, 1988

[30] Foreign Application Priority Data

Dec. 17, 1987 [DE] Fed. Rep. of Germany ..... 3742876

[51] Int. Cl.[4] ..... F22B 1/02

[52] U.S. Cl. ..... 122/32; 122/34; 122/DIG. 11; 122/DIG. 14; 432/3; 432/76

[58] Field of Search ..... 122/209, 221, 223, 32, 122/34, DIG. 11, DIG. 14; 432/3, 76

[56] References Cited

U.S. PATENT DOCUMENTS

| | | | |
|---|---|---|---|
| 4,173,997 | 11/1979 | Andrews et al. | 122/32 |
| 4,345,549 | 8/1982 | Colmano | 122/DIG. 11 |
| 4,535,727 | 8/1985 | Ziegler | 432/3 |
| 4,641,607 | 2/1987 | Balazs et al. | 122/209 R |
| 4,664,069 | 5/1987 | Alden, Jr. | 122/32 |

*Primary Examiner*—Henry C. Yuen

*Attorney, Agent, or Firm*—Herbert L. Lerner; Laurence A. Greenberg

[57] ABSTRACT

A vertically disposed steam generator includes a pressure vessel containing: a tube plate, chambers, a bundle of U-shaped bent heating tubes with supporting anchors, a steam trap above the heating tubes, and tubes for a secondary medium discharging into the pressure vessel. The heating tubes have ends guided through openings in the tube plate and discharging a primary medium into the chambers. A method and apparatus for renewing the steam generator includes disconnecting the tubes for the secondary medium; dividing the pressure vessel into an upper region forming a steam dome and a middle region with a jacket surrounding the bundle of heating tubes while leaving a lower region having the chambers; successively raising the steam dome, the steam trap and the jacket; disconnecting the heating tubes and the anchors above the tube plate, and raising the entire bundle; removing remaining parts of the heating tubes from the tube plate and preparing free openings for receptacles of new heating tubes; introducing a prefabricated new bundle having new anchors and heating tubes, introducing the ends of the new anchors and heating tubes into the openings of the tube plate and connecting the ends of the new anchors and heating tubes to the tube plate; and replacing the disconnected jacket, the raised steam trap and the disconnected steam dome, and reestablishing the previous connections of the tubes for the secondary medium.

11 Claims, 7 Drawing Sheets

Figure 1:
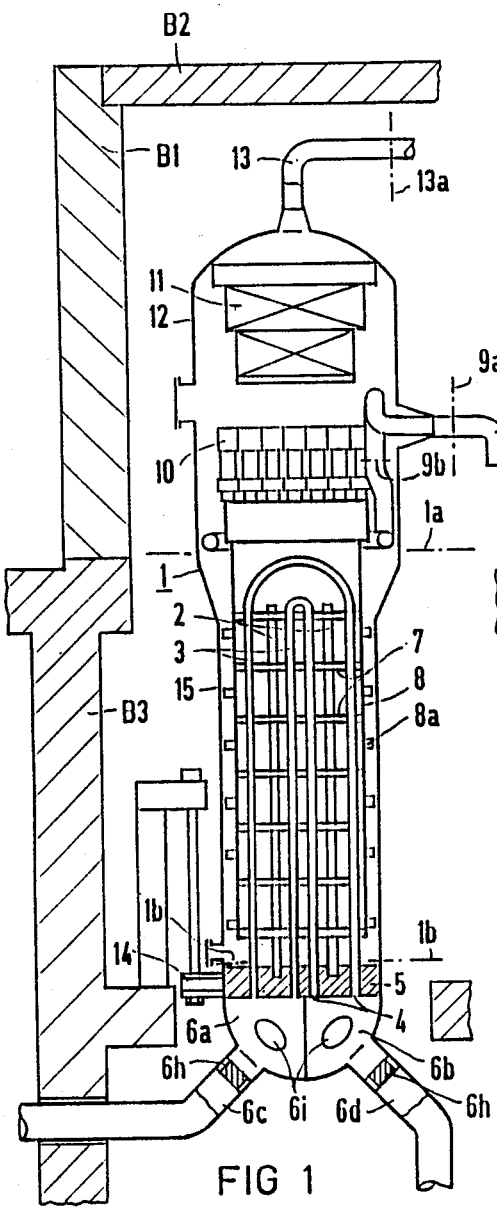

METHOD AND APPARATUS FOR RENEWING A VERTICALLY DISPOSED STEAM GENERATOR, IN PARTICULAR IN NUCLEAR POWER PLANTS

The invention relates to a method and an apparatus for renewing a vertically disposed steam generator, especially in nuclear power plants, including a bundle of U-shaped bent heating tubes being provided with supporting anchors and being contained inside a pressure vessel, the ends of the heating tubes being guided through openings in a tube plate and discharging into chambers through which a primary medium flows, a steam trap disposed above the heating tubes, and tubes for a secondary medium discharging into the pressure vessel.

The service life of a steam generator of the kind described above is substantially determined by the capability of its heating tubes to function. The heating tubes perform the function of reliably separating the primary medium from the secondary medium, so that no mixing of primary and secondary medium can occur. In order to meet the requirement for the most efficient possible heat transition from the primary to the secondary region, the largest possible heat transition surfaces are built in. The efficiency is further promoted by using thin-walled medium-separating partitions, so that an ideal heat transfer takes place. Technologically, this means that in a steam generator having heating tubes, a very large number of thin-walled heating tubes are used.

If the cooling media are water, the materials of the steam generator are subjected to a certain amount of corrosion, and to reduce this, chemical substances are added to the cooling water. Nevertheless, corrosive substances typically tend to accumulate at stagnant spots in the flow. If these substances then cause the destruction of heating tubes, they can no longer perform their medium-separating function, and the steam generator must be renewed.

If only a few heating tubes are damaged, they can be taken out of operation by means of stopper bolts. However, if there is extensive damage to the heating tubes of large steam generators equipped with several thousand heating tubes, such as are used in nuclear power plants, then the entire steam generator is replaced.

This is the selected procedure in nuclear power plants, because the time required for complete replacement and therefore the down time of the plant, can be predicted. The radiation load to the personnel performing the replacement, and the resultant number of persons used, argue in favor of a complete replacement.

It is accordingly an object of the invention to provide a method and an apparatus for renewing a vertically disposed steam generator, especially in nuclear power plants, which overcomes the hereinafore-mentioned disadvantages of the heretofore-known methods and devices of this general type, in which resumption of operation is possible in the shortest possible time at low manufacturing costs, especially in the event of a sudden malfunction in a steam generator, and in which the volume of contaminated parts that must be dismantled, stored and monitored or disposed of is as low as possible.

With the foregoing and other objects in view there is provided, in accordance with the invention, in a vertically disposed steam generator including a pressure vessel, a tube plate disposed in the pressure vessel, chambers disposed in the pressure vessel, a bundle of U-shaped bent heating tubes with supporting anchors disposed in the pressure vessel, the heating tubes having ends guided through openings formed in the tube plate and discharging a primary medium into the chambers, a steam trap disposed above the heating tubes in the pressure vessel, and tubes for a secondary medium discharging into the pressure vessel, a method for renewing the steam generator which comprises:

(a) disconnecting the tubes for the secondary medium;

(b) dividing the pressure vessel to produce an upper region forming a steam dome and a middle region with a jacket surrounding the bundle of heating tubes while leaving a lower region having the chambers for the primary medium;

(c) successively raising the steam dome, the steam trap and the jacket;

(d) disconnecting the heating tubes and the supporting anchors above the tube plate, and raising the entire bundle of heating tubes;

(e) removing remaining parts of the heating tubes from the tube plate and preparing free openings for receptacles of new heating tubes;

(f) introducing a prefabricated new bundle having new supporting anchors and heating tubes, introducing the ends of the new supporting anchors and heating tubes into the openings of the tube plate and connecting the ends of the new supporting anchors and heating tubes to the tube plate; and (g) replacing the disconnected jacket, the raised steam trap and the disconnected steam dome, and reestablishing the previous connections of the tubes for the secondary medium.

With the objects of the invention in view, there is also provided, in a vertically disposed steam generator including a pressure vessel, a tube plate disposed in the pressure vessel, chambers disposed in the pressure vessel, a bundle of U-shaped bent heating tubes with supporting anchors disposed in the pressure vessel, the heating tubes having ends guided through openings formed in the tube plate and discharging a primary medium into the chambers, a steam trap disposed above the heating tubes in the pressure vessel, and tubes for a secondary medium discharging into the pressure vessel, a method for partially renewing the steam generator which comprises:

(a) disconnecting the tubes for the secondary medium;

(b) dividing the pressure vessel producing an upper region forming a steam dome and a middle region having a jacket containing the bundle of heating tubes and the tube plate while leaving a lower region having the chambers for the primary medium;

(c) successively raising the steam dome and the steam trap;

(d) raising the jacket, the bundle of heating tubes and the tube plate;

(e) mounting the jacket with new heating tubes and supporting anchors inserted into the tube plate upon the chambers and connecting the jacket; and (f) replacing the raised steam trap and the disconnected steam dome, and reestablishing the previous connections of the tubes for the secondary medium.

In accordance with another mode of the invention, there is provided a method which comprises, in conjunction with step (d):

(d1) severing the jacket, the heating tubes and the supporting anchors above the tube plate, (d2) removing remaining remnants of the heating tubes from the tube plate, and preparing free openings for receiving new heating tubes, (d3) introducing a new bundle having supporting anchors and heating tubes into the tube plate, introducing the ends of the new supporting anchors and heating tubes into the openings of the tube plate and joining the ends of the new supporting anchors and heating tubes to the tube plate, and (d4) re-joining the portion of the jacket severed above the tube plate to the annular portion of the jacket surrounding the tube plate.

A common feature of both versions is that substantially only one new bundle of heating tubes needs to be installed on site. The majority of the structural components of the steam generator is reusable after the heating tubes have been replaced, so that components to be stored or disposed of are substantially limited to the old heating tubes. The final storage or disposition is simplified through the use of previous decontamination of the primary region, and in particular the radiation load to personnel is reduced.

In nuclear power plants having a transport lock, the old or new bundle of heating tubes can be transported without dismantling the transport gate. As a result, the air retention means can be kept small in size. It is also unnecessary to test for a tight seal on the containment prior to resumption of operation of the power plant. In plants that do not have transport openings and which therefore must be provided with openings in the building walls in order to replace components, as well as in plants that only have small openings for constructional reasons, the small size of the replacement part is particularly important, so that the safety of the building after the replacement is again guaranteed.

A further advantage of the features and steps according to the invention is that existing lifting tools for work in the power plant can be used and need not be reinforced, because only a portion of the entire weight need be transported. The low load on the crane means that it is possible to dispense with additional provisions in the form of intercepting frameworks along the path of movement of the crane which are used to prevent collapse. This also prevents the generation of a large quantity of contaminated waste later on.

The small space requirement for storing replacement tube bundles also permits an inventory to be kept on hand at reasonable cost, which enables a prompt response to sudden malfunctions.

Since the primary tubes leading to the chambers of the steam generator need not be separated, the tube forces are not changed, in contrast to the replacement of the entire steam generator.

Finally, manufacture of the replacement heating tube bundle can be carried out without a major expenditure of effort and time for obtaining permits, so that the construction time for the bundle can be kept short.

There are also provided apparatus for performing the methods described above.

Furthermore, in accordance with a further feature of the invention, the new supporting anchors of the new bundle of heating tubes to be installed are disposed at location at which the heating tubes were located, and there are provided collars supporting the ends of the new supporting anchors guided through the openings in the tube plates on the tube plates, and means for securing the new supporting anchors on the tube plate from the chambers for the primary medium.

In accordance with an added feature of the invention, there is provided a flow guidance jacket surrounding the new bundle of heating tubes, and supports disposed on the flow guidance jacket for anchoring on the tube plate.

In accordance with an additional feature of the invention, there are provided devices for positioning free tube ends and lower ends of the new supporting anchors for introduction of the heating tubes into the tube plate in the form of a grid and to be removed after the introduction.

In accordance with yet another feature of the invention, there are provided heating devices for heating the jacket before it is folded over the new bundle of heating tubes.

In accordance with a concomitant feature of the invention, there are provided heating devices for heating the jacket before it is raised from the old bundle of heating tubes.

Other features which are considered as characteristic for the invention are set forth in the appended claims.

Although the invention is illustrated and described herein as embodied in a method and apparatus for renewing a vertically disposed steam generator, in particular in nuclear power plants, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 7:
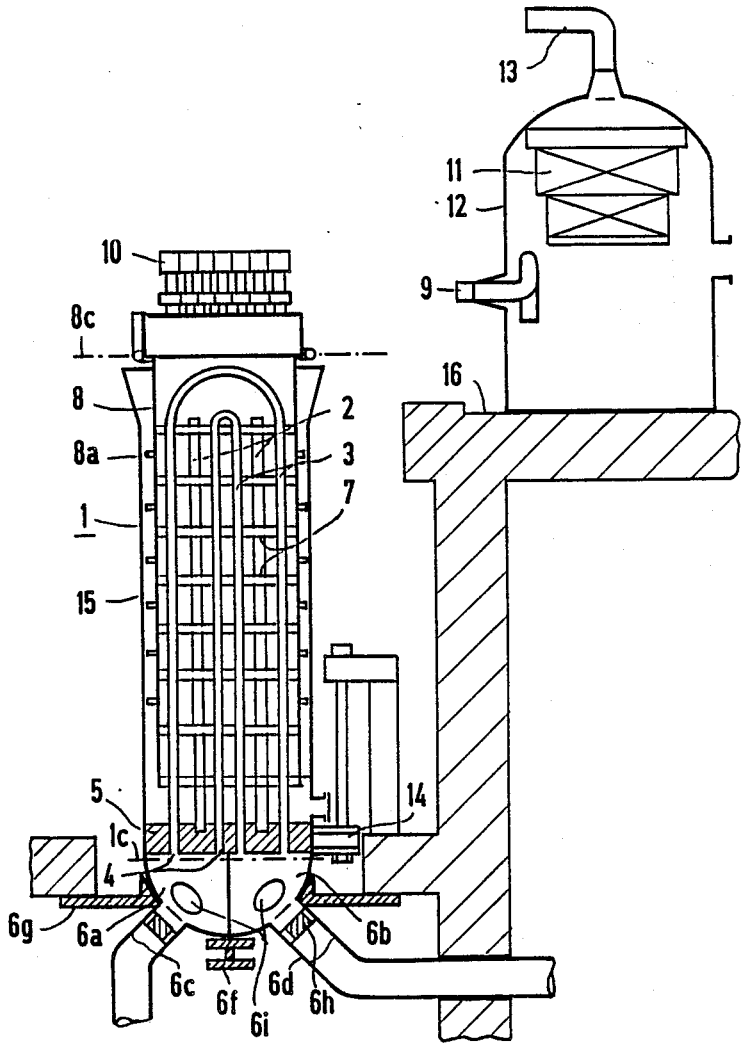
Figures 8, 9:
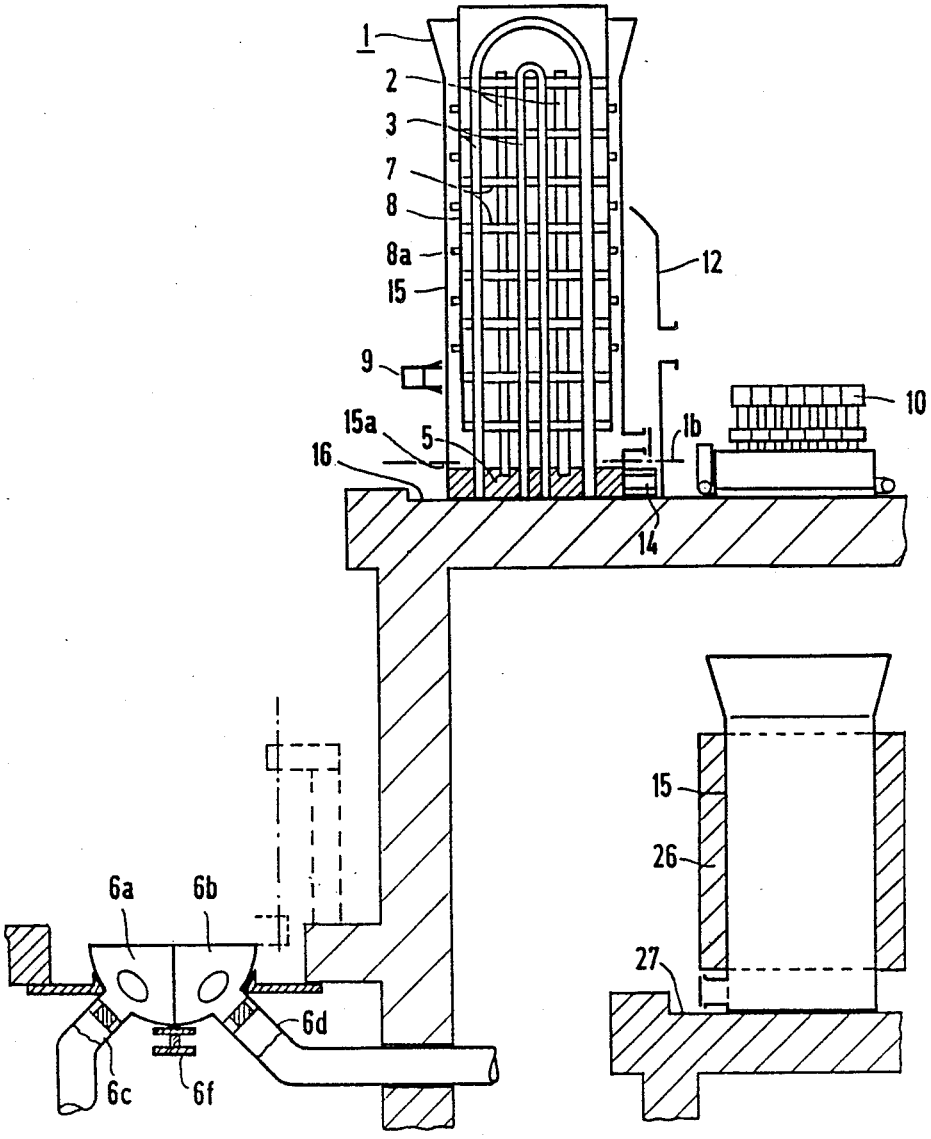
Figure 10:
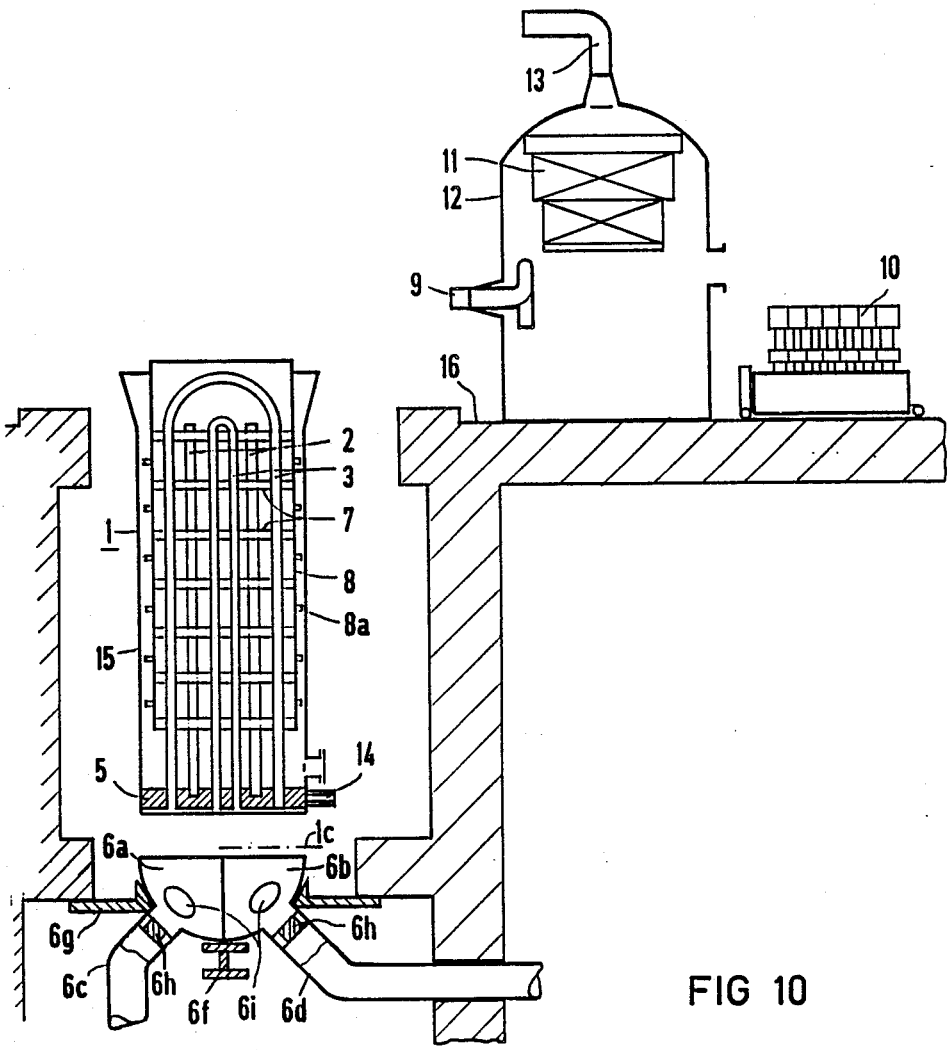

FIGS. 1–6 are fragmentary, diagrammatic, longitudinal-sectional views illustrating method steps for a heating tube replacement, in which the lower ends of all the heating tubes are cut off above the tube plate or tube sheet, so that the tube plate remains firmly connected to the primary loop;

FIGS. 7–9 are fragmentary, longitudinal-sectional views illustrating method steps for renewing the steam generator, in which the heating tubes are not separated from the tube plate, but instead the outer jacket is separated at the transition to the primary chambers, and the tube plate is replaced as well, but can later be reused; and FIG. 10 is a fragmentary, longitudinal-sectional view illustrating the renewal of a bundle of heating tubes that is raised from the primary chambers together with the jacket and the tube plate and replaced as a unit.

Referring now to the figures of the drawings in detail and first, particularly, to FIG. 1 thereof, there is seen a steam generator of a nuclear power plant, in which a bundle of U-shaped bent heating tubes 3 provided with supporting anchors 2 is disposed inside a pressure vessel 1. Only two of the heating tubes or pipes are shown in the drawing. The ends of the heating tubes 3 are guided through openings 4 in a tube plate or tube sheet 5 and discharge into chambers *6a, 6b,* through which a primary medium flows. A tube fitting, connection, socket or stub *6c* which is introduced into one chamber *6a,* is connected through a pipeline to a reactor pressure vessel, from which the primary medium flows to the steam generator, through the bundle of pipelines 3, through the other chamber 6b, through a pipeline 6d, through a pump and is returned to the reactor pressure vessel. One sealing insert 6h is located in each of the pipe fittings 6c and the pipeline 6d, after having been introduced through the inspection opening 6i. The heating tubes 3 are fixed by grid-like spacers 7 and surrounded by a flow guidance jacket 8. Spacer rails 8a are provided on the outside of the flow guidance Jacket 8. The feedwater on the secondary side is supplied through a pipeline 9 in such a manner that it is guided downward through the flow guidance jacket 8 and from there flows from bottom to top as uniformly as possible along the outside of all of the heating tubes 3. The vessel of the steam generator becomes larger at the top to form a steam collecting chamber, in which a steam trap 10 and a water trap 11 are disposed. A steam dome 12 forming a steam collecting chamber has a steam outlet fitting which communicates with a turbine through a pipeline 13 at the top thereof.

At the level of the tube plate 5, supporting and guide claws 14 are disposed on the pressure vessel for supported the steam generator on a building.

If there is predetermined damage to the heating tubes, then after components B1 and B2 are lifted from a fixed building B3 for partial renewal of a vertically disposed steam generator, the tubes 9 and 13 for the secondary medium (feedwater and steam) are separated at parting lines 9a, 9b, 13a. The pressure vessel 1 is then divided at section lines 1a, 1b in such a way that an upper region that forms the steam dome 12 is produced, a middle region that has a jacket 15 surrounding the bundle of heating tubes 3 is created, and a lower region having the chambers 6a, 6b for the primary medium remains.

Figure 2:
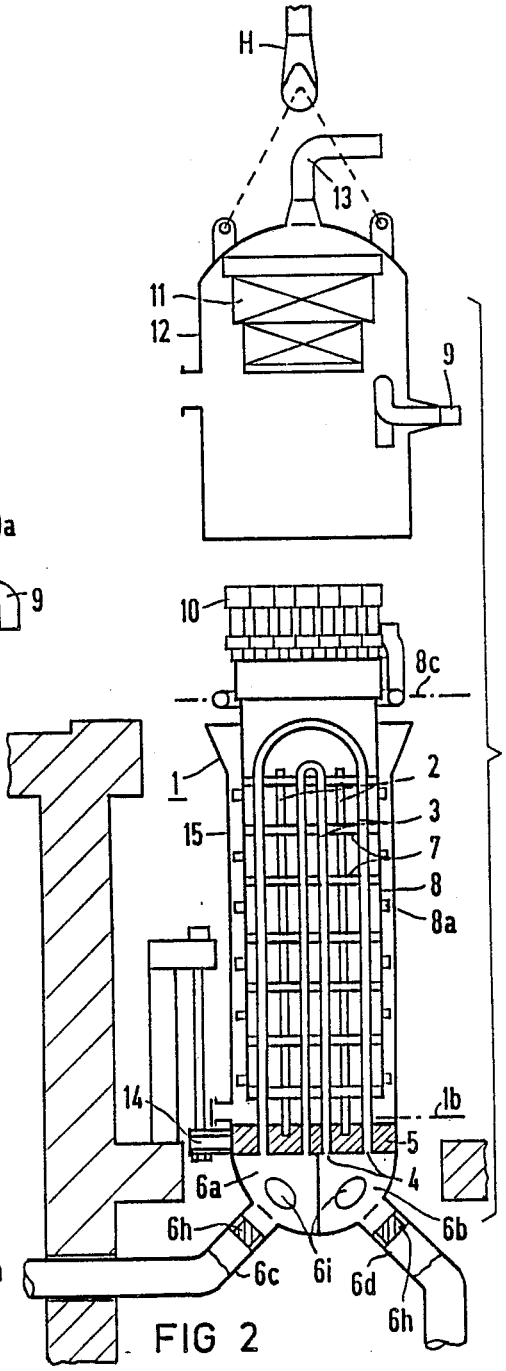
Figure 3:
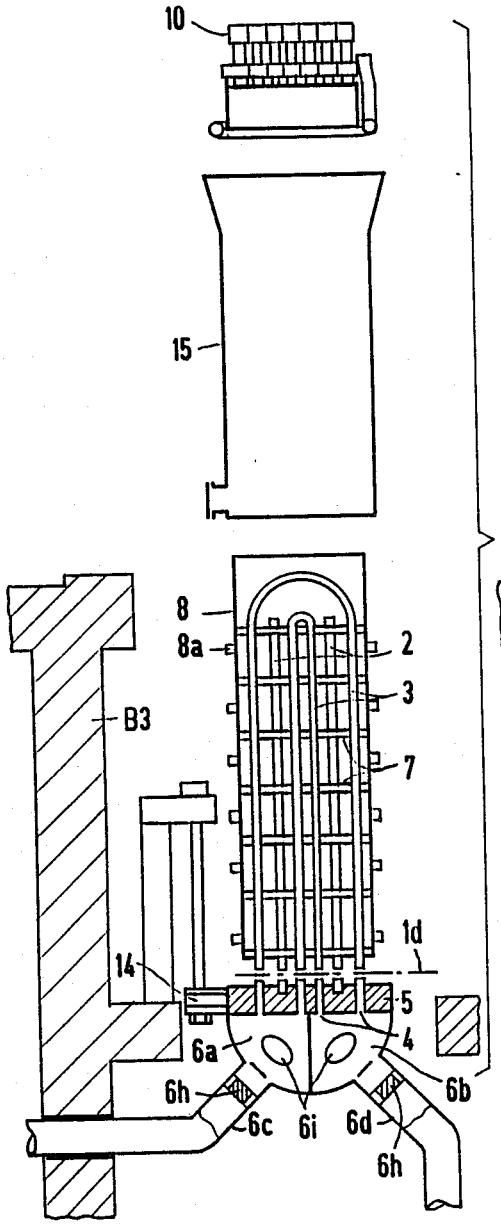

At this point, the steam dome 12 along with the water trap 11, and after the fastenings are released at the section line 8c, the steam trap 10 and the jacket 15, can be raised in succession with the building crane H, as shown in FIGS. 2 and 3, and removed to a temporary storage area next to the steam generator.

The heating tubes 3 and the supporting anchors 2 are separated above the tube plate 5 at a tube bundle section line 1d shown in FIG. 3. Then the entire bundle of heating tubes 3 can be raised and transported through the transport gate of the reactor building. The heating tubes are transferred for disposal, while the supporting anchors 2 and the spacers 7 as well as the flow guidance jacket 8 can be reused later.

Figure 4:
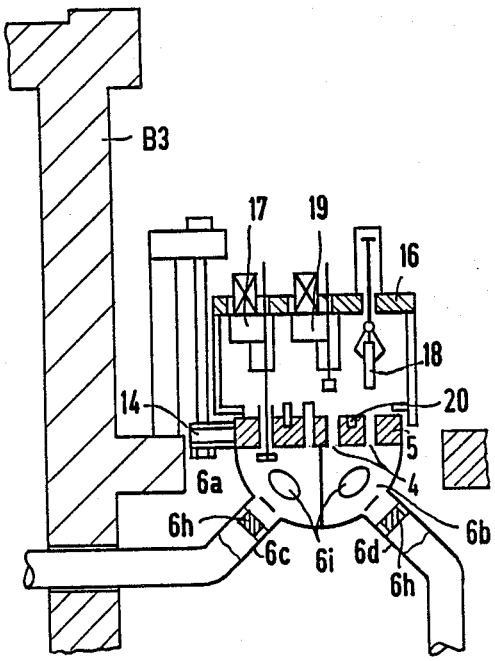

As indicated in FIG. 4, a work platform 16 having a plurality of multi-spindle or screw machines 17 for simultaneously milling open the tube welding seams, is mounted on the tube plate. Pulling devices 18 for the remaining parts of the heating tubes can also be provided on the work platform 16. Smoothing tools 19 are used to smooth the bores.

In order to fasten a new bundle of heating tubes 3, some of the existing tube bores are prepared for supporting anchors which are guided through them. These anchors are located in the new bundle of tubes at same positions as in the previous heating bundle, which is done after the remnants of the old anchoring rods that were inserted in the threaded bores 20, have been removed. The threaded bores 20 are closed, and the tube plate 5 is then prepared to receive new heating tubes 3.

Figure 5:
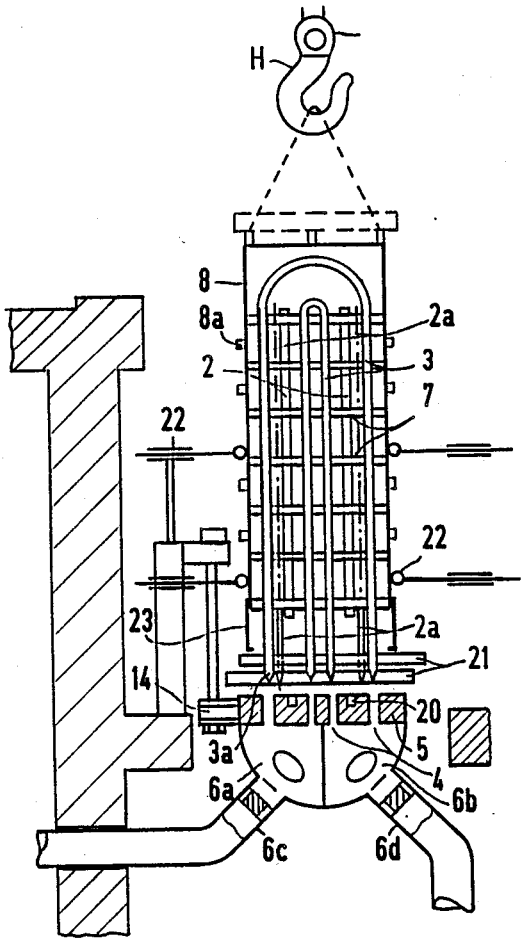

As FIG. 5 shows, a new bundle which is made in the factory or on site and has new supporting anchors 2a and heating tubes 3 surrounded by a flow guidance jacket 8, is brought in with the aid of the building crane H. The ends of the supporting anchors 2a and the heating tubes 3 are provided with insertion cones 3a and are fixable by means of centering aids, such as sheet-metal strips 21, so that they can be threaded into the openings 4 in the tube plate 5. Guide tools 22 are also used for guiding and directing the replacement tube bundles to be inserted. The guide tools make it possible to precisely align the tube ends with the openings 4 of the tube plate 5 As a result, the insertion process can be performed reliably. During the insertion process, the grid-like centering aid is removed laterally, so that new supports 23 of the bundle of tubes can sit on the tube plate 5.

Figures 6, 6A:
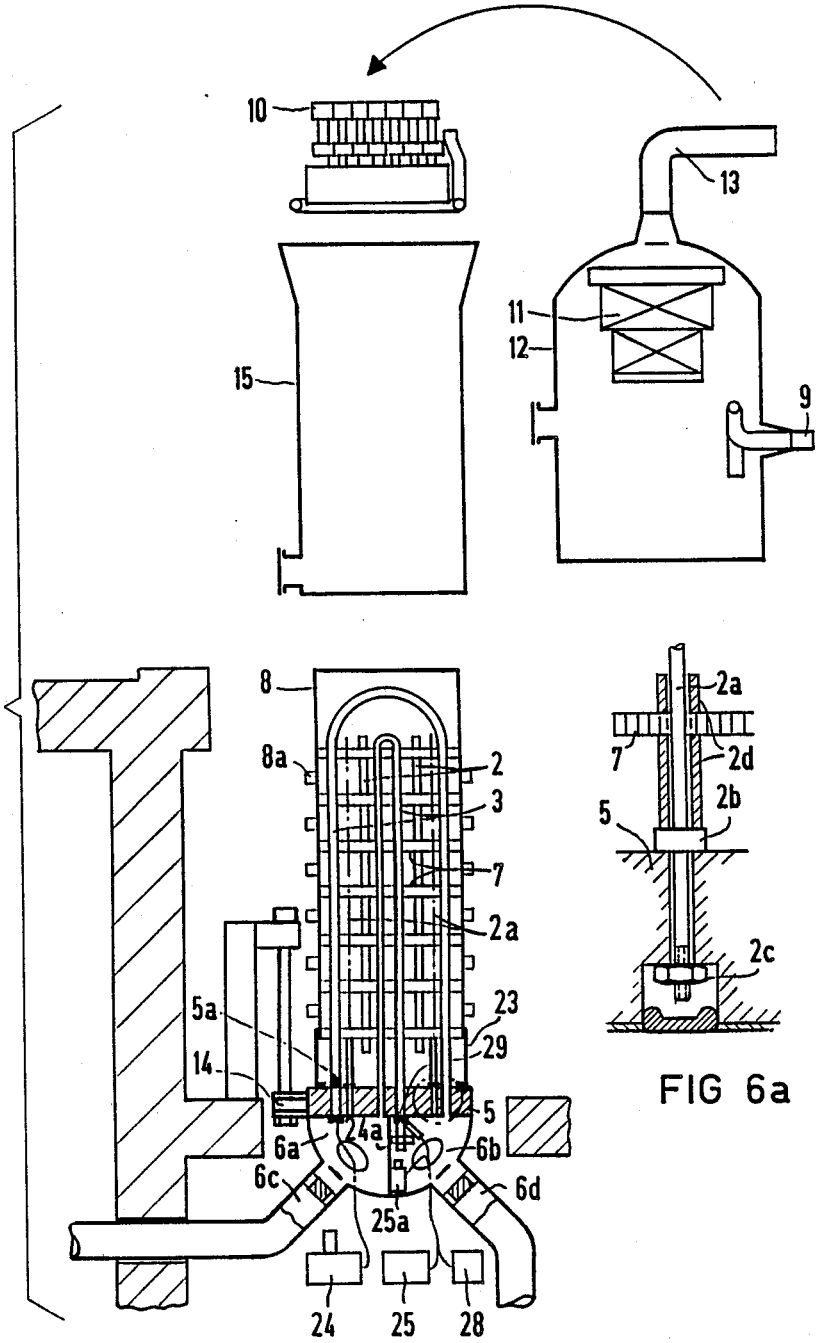

After the introduction of the tube ends, the new supporting anchors 2a rest on the tube plate with collars 2b thereof, as seen in FIGS. 6, 6a and the anchors penetrate the tube plate, where they are secured from below by nuts 2c. The spacers 7 are supported by means of spacer sheaths 2d and the flow guidance jacket 8 is supported by means of the supports 23. The new heating tubes 3 are made longer than necessary, and the ends thereof protrude with beyond the tube plate 5 into the interior of the chambers for the primary medium.

A further phase in the mechanical machining is then performed. This includes the steps of flaring the tube ends in order to place the tube 3 into the bores in the vicinity of the tube plate 5; cutting the tubes 3 to the proper length and rewelding the tube ends to the underside of the tube plate. The flaring process is suitably performed by hydraulic action on the internal regions of the tube ends, with the tube ends sealed off above the tube plate 5 by means of stoppers 5a being connected to a pump 24. With this method, a fast flaring process is possible, and the simplicity of the flaring process permits simultaneous treatment of multiple tube ends.

The protruding tubes which are set into place, are then cut to length and then tightly welded to the tube plate 5.

All of the work in the chambers 6a, 6b for the primary medium, including the welding work, can largely be performed simultaneously, if suitable machines are used It is favorable to still further shorten the time for renewal of the steam generator by providing that the external connection processes, such as the mounting of the jacket 15 and the steam dome 12, coincide with the work done in the chambers 6a, 6b. If the preheating of the lower welding point between the tube plate 5 and jacket 15 does not unfavorably affect the work in the chambers 6a, 6b, then this welding connection can also be executed in a parallel process. In order to make this possible with reliability, it is suitable to bring a cooling or heat-insulating device into the chambers 6a, 6b and to keep it accessible during welding.

It is suitable to use remote-control machines 28 and tools 29 (automatic welding unit) for use in the chambers 6a, 6b, which can be observed by a television camera 25a through monitors 25. Direct intervention by hand and therefore by physically climbing into the chambers 6a, 6b will then only be necessary for inspections, in the event of malfunctions or upon re-installation of machines.

Once all of the heating tube ends are welded to the tube plate 5, a tightness test can be performed. After the jacket 15 and steam dome 12 are mounted and welded, the steam generator, for instance, is filled on the secondary side with helium, for instance, for the purpose of the tightness test, and the weld connections of the heating tubes 3 inside the chambers 6*a*, 6*b* can then be tested for tightness. Later, pressure tests are suitably performed, with the entire plant being covered during these tests.

The process of replacement of the bundle of heating tubes is thus concluded. Finally, a prior effective decontamination of the primary region, particularly of the chambers 6*a*, 6*b* for the primary medium and of the lower end portion of the heating tubes 3, prior to dismantling the first bundle, contributes to speeding up the work, simplifies final disposition of the replacement parts, and keeps the human exposure low.

FIGS. 7–9 show a method for renewing a steam generator by replacement of the defective heating tube bundle, in which the tube plate 5 is replaced as well First the steam generator 1 is provided at the bottom with supports 6*f*, 6*g*. Then the tubes 9, 13 for the secondary medium are separated from the lines as shown in FIG. 7, and the pressure vessel 1 is divided in such a way as to produce an upper region that forms the steam dome 12, in order to create a middle region that has a jacket 15 containing the bundle of heating tubes 3 and the tube plate 5, while a lower region having the chambers 6*a*, 6*b* for the primary medium remains With this kind of procedure, the tube plate 5 is separated from the chambers 6*a*, 6*b* by a severing cut along a section line 1*c* of the upper wall region as seen in FIG. 7; then the steam dome 12 is raised and set aside with the building crane H.

The removal of the steam trap 10, which is fred from the upper region of the bundle of tubes at the section line 8*c* by means of a severing cut or by loosening screw connections, then takes place After the steam trap 10 has been raised, it is set aside at the temporary storage location 16 seen in FIG. 8.

The jacket 15, the bundle of heating tubes 3 and the tube plate 5 are then raised and set aside at the storage location 16. The jacket 15 is then cut through at the section line 1*b*, above the tube plate 5. In further steps, the jacket 15 is removed from the bundle of heating tubes and inspected at an inspection location 27 seen in FIG. 9. Preferably, the jacket 15 is then folded over a prepared new bundle of heating tubes which is prefabricated in the factory and is already connected to a tube plate 5 and an annular portion 15*a* of the jacket 15 that surrounds the tube plate. It is also possible to insert a unit which is prefabricated in the factory and consists of a new jacket with a new bundle of heating tubes. After being welded to the tube plate 5, the Jacket 15, with new heating tubes 3 and supporting anchors 2 inserted into the tube plate 5, can be mounted-on and connected to the chambers 6*a*, 6*b*. It is advantageous in this connection to provide heating devices 26, for instance in the form of an inductive heating coil, for heating the jacket 15 before it is removed or folded over the new bundle of heating tubes 3. By heating the jacket 15 with the heating device 26, a gap is formed between the spacer rails 8*a* of the flow guidance jacket 8 and the inner periphery of the jacket 15, which facilitates raising the jacket 15 from the flow guidance jacket 8 of the heating tube bundle 3 as well as re-mounting it.

It is also possible, however, to bring the jacket 15, the bundle of old heating tubes 3 and the tube plate 5 to a temporary storage location 27 after they have been lifted away from the chambers 6*a*, 6*b*, and after severing the jacket 15, heating tubes 3 and supporting anchors 2 at the section line 1*b* above the tube plate 5, removing the remaining remnants of the heating tubes 3 from the tube plate 5, as already described in connection with FIG. 4 to prepare the free openings 4 for the reception of new heating tubes 3, introducing a new bundle with new supporting anchors 2*a*, heating tubes 3 and the flow guidance jacket 8 into the tube plate 5, introducing the ends of the supporting anchors 2*a* and heating tubes 3 into the openings 4 of the tube plate 5, and connecting them to the tube plate 5, as shown in FIG. 6. Subsequently, the portion of the jacket severed above the tube plate 5 is re-joined to the annular portion 15*a* of the jacket 15 surrounding the tube plate 5, thus providing a replacement component in which only the heating tubes 3 and the supporting anchors 2 are renewed.

After the replacement components have been lowered on the chambers 6*a*, 6*b*, the jacket 15 is welded to the walls of the chambers 6*a*, 6*b*. The steam trap 10 is then joined to the new replacement heating tube bundle, and the severed steam dome 12 is mounted in place once again. Finally, the earlier connections, with the secondary region included as well, are reestablished.

The kind of procedures illustrated in FIGS. 7–9 have the advantage of permitting many work operations to be easily performed at a temporary storage location or to be shifted to the factory. In particular, the many heating tube connections with the tube plate 5 and tests are advantageously performed in the factory, which facilitates installation on site.

A further possibility for keeping work on site to a minimum is illustrated in FIG. 10. According to the FIG. 10 embodiment, in order to renew the heating tube bundle after severing the steam dome 12 and the jacket 15 below the tube plate 5, first the steam dome 12 along with the water trap 11, then the steam trap 10 and subsequently the jacket 15 together with the tube plate 5 and the bundle of heating tubes 3, are raised. Then, a unit which is manufactured in the factory and is formed of a bundle of heating tubes 3 connected to a tube plate 5 and a jacket 15 surrounding the heating tubes, is mounted on the chambers 6*a*, 6*b*. Subsequently, the original steam trap 10 and the steam dome 12 are installed, and the required connections are reestablished.

The foregoing is a description corresponding in substance to German Application No. P 37 42 876.4, dated Dec. 17, 1987, the International priority of which is being claimed for the instant application, and which is hereby made part of this application. Any material discrepancies between the foregoing specification and the aforementioned corresponding German application are to be resolved in favor of the latter.

I claim:

1. In a vertically disposed steam generator including a pressure vessel, a tube plate disposed in the pressure vessel, chambers disposed in the pressure vessel, a bundle of U-shaped bent heating tubes with supporting anchors disposed in the pressure vessel, the heating tubes having ends guided through openings formed in the tube plate and discharging a primary medium into the chambers, a steam trap disposed above the heating tubes in the pressure vessel, and tubes for a secondary medium discharging into the pressure vessel, a method for renewing the steam generator which comprises:

(a) disconnecting the tubes for the secondary medium:

(b) dividing the pressure vessel to produce an upper region forming a steam dome and a middle region with a jacket surrounding the bundle of heating tubes while leaving a lower region having the chambers for the primary medium;

(c) successively raising the steam dome, the steam trap and the jacket;

(d) disconnecting the heating tubes and the supporting anchors above the tube plate, and raising the entire bundle of heating tubes;

(e) removing remaining parts of the heating tubes from the tube plate and preparing free openings for receptacles of new heating tubes;

(f) introducing a prefabricated new bundle having new supporting anchors and heating tubes, introducing the ends of the new supporting anchors and heating tubes into the openings of the tube plate and connecting the ends of the new supporting anchors and heating tubes to the tube plate; and (g) replacing the disconnected jacket, the raised steam trap and the disconnected steam dome, and reestablishing the previous connections of the tubes for the secondary medium.

2. In a vertically disposed steam generator including a pressure vessel, a tube plate disposed in the pressure vessel, chambers disposed in the pressure vessel, a bundle of U-shaped bent heating tubes with supporting anchors disposed in the pressure vessel, the heating tubes having ends guided through openings formed in the tube plate and discharging a primary medium into the chambers, a steam trap disposed above the heating tubes in the pressure vessel, and tubes for a secondary medium discharging into the pressure vessel, a method for partially renewing the steam generator which comprises:

(a) disconnecting the tubes for the secondary medium;

(b) dividing the pressure vessel producing an upper region forming a steam dome and a middle region having a jacket containing the bundle of heating tubes and the tube plate while leaving a lower region having the chambers for the primary medium;

(c) successively raising the steam dome and the steam trap:

(d) raising the jacket, the bundle of heating tubes and the tube plate;

(e) mounting the jacket with new heating tubes and supporting anchors inserted into the tube plate upon the chambers and connecting the jacket; and (f) replacing the raised steam trap and the disconnected steam dome, and reestablishing the previous connections of the tubes for the secondary medium.

3. Method according to claim 2, which comprises, in conjunction with step (d):

(d1) severing the jacket, the heating tubes and the supporting anchors above the tube plate, (d2) removing remaining remnants of the heating tubes from the tube plate, and preparing free openings for receiving new heating tubes, (d3) introducing a new bundle having supporting anchors and heating tubes into the tube plate, introducing the ends of the new supporting anchors and heating tubes into the openings of the tube plate and joining the ends of the new supporting anchors and heating tubes to the tube plate, and (d4) re-joining the portion of the jacket severed above the tube plate to the annular portion of the jacket surrounding the tube plate.

4. In a vertically disposed steam generator including a pressure vessel, a tube plate disposed in the pressure vessel, chambers disposed in the pressure vessel, a bundle of U-shaped bent heating tubes with supporting anchors disposed in the pressure vessel, the heating tubes having ends guided through openings formed in the tube plate and discharging a primary medium into the chambers, a steam trap disposed above the heating tubes in the pressure vessel, and tubes for a secondary medium discharging into the pressure vessel, an apparatus for renewing the steam generator comprising:

(a) means for disconnecting the tubes for the secondary medium;

(b) means for dividing the pressure vessel to produce an upper region forming a steam dome and a middle region with a jacket surrounding the bundle of heating tubes while leaving a lower region having the chambers for the primary medium (c) means for successively raising the steam dome, the steam trap and the jacket;

(d) means for disconnecting the heating tubes and the supporting anchors above the tube plate, and raising the entire bundle of heating tubes;

(e) means for removing remaining parts of the heating tubes from the tube plate and preparing free openings for receptacles of new heating tubes;

(f) a prefabricated new bundle having new supporting anchors and heating tubes, the new supporting anchors and heating tubes having ends to be introduced into the openings of the tube plate and connected to the tube plate; and (g) means for replacing the disconnected jacket, the raised steam trap and the disconnected steam dome and for reestablishing the previous connections of the tubes for the secondary medium.

5. In a vertically disposed steam generator including a pressure vessel, a tube plate disposed in the pressure vessel, chambers disposed in the pressure vessel, a bundle of U-shaped bent heating tubes with supporting anchors disposed in the pressure vessel, the heating tubes having ends guided through openings formed in the tube plate and discharging a primary medium into the chambers, a steam trap disposed above the heating tubes in the pressure vessel, and tubes for a secondary medium discharging into the pressure vessel, an apparatus for partially renewing the steam generator comprising:

(a) means for disconnecting the tubes for the secondary medium;

(b) means for dividing the pressure vessel producing an upper region forming a steam dome and a middle region having a jacket containing the bundle of heating tubes and the tube plate while leaving a lower region having the chambers for the primary medium;

(c) means for successively raising the steam dome and the steam trap;

(d) means for raising the jacket, the bundle of heating tubes and the tube plate (e) the jacket with new heating tubes and supporting anchors inserted into the tube-plate being mounted upon the chambers and connected; and (f) means for replacing the raised steam trap and the disconnected steam dome and for reestablishing the previous connections of the tubes for the secondary medium.

6. Apparatus according to claim 5, including:

(d1) means for severing the jacket, the heating tubes and the supporting anchors above the tube plate, (d2) means for removing remaining remnants of the heating tubes from the tube plate and for preparing free openings for receiving new heating tubes, (d3) means for introducing a new bundle having supporting anchors and heating tubes into the tube plate, for introducing the ends of the new supporting anchors and heating tubes into the openings of the tube plate and for joining the ends of the new supporting anchors and heating tubes to the tube plate, and (d4) means for re-joining the portion of the jacket severed above the tube plate to the annular portion of the jacket surrounding the tube plate.

7. Apparatus according to claim 6, wherein said ne supporting anchors of said new bundle of heating tubes to be installed are disposed at location at which the heating tubes were located, and including collars supporting the ends of said new supporting anchors guided through the openings in the tube plates on the tube plates, and means for securing said new supporting anchors on the tube plate from the chambers for the primary medium.

8. Apparatus according to claim 7, including a flow guidance jacket surrounding said new bundle of heating tubes, and supports disposed on said flow guidance jacket for anchoring on the tube plate.

9. Apparatus according to claim 7, including devices for positioning free tube ends and lower ends of said new supporting anchors for introduction of the heating tubes into the tube plate in the form of a grid and to be removed after the introduction.

10. Apparatus according to claim 7, including heating devices for heating the Jacket before it is folded over said new bundle of heating tubes.

11. Apparatus according to claim 7, including heating devices for heating the jacket before it is raised from the old bundle of heating tubes.

* * * * *